US005271525A

United States Patent [19]

Petrie

[11] Patent Number: 5,271,525

[45] Date of Patent: Dec. 21, 1993

[54] INFLATION MANIFOLD

[76] Inventor: Ross J. Petrie, 2527 Bimini La., Fort Lauderdale, Fla. 33312

[21] Appl. No.: 836,705

[22] Filed: Feb. 18, 1992

[51] Int. Cl.[5] ..... B67D 5/00

[52] U.S. Cl. ..... 222/5; 222/83.5; 441/94

[58] Field of Search ..... 222/5, 83, 83.5; 441/92, 93, 94

[56] References Cited

U.S. PATENT DOCUMENTS

| | | | |
|---|---|---|---|
| 2,946,484 | 7/1960 | Stoner | 222/83 X |
| 3,227,309 | 1/1966 | Segrest | 222/5 X |
| 3,490,648 | 1/1970 | Fujimoto | 222/5 |
| 3,494,506 | 2/1970 | Fujimoto | 441/94 X |
| 3,809,288 | 5/1974 | Mackal | 222/5 |
| 3,815,783 | 6/1974 | Hirata | 222/5 |
| 4,416,393 | 11/1983 | Zimmerly | 222/5 |
| 4,489,855 | 12/1984 | Boetger | 222/5 |
| 4,498,604 | 2/1985 | Mackal | 222/5 |
| 4,524,885 | 6/1985 | Zimmerly | 222/5 |

*Primary Examiner*—David M. Mitchell
*Assistant Examiner*—Kenneth Bomberg

[57] ABSTRACT

A manifold for use with an inflatable article such as a life raft, life vest, and other articles used in aircraft and marine safety and the like, an improved puncture pin and dual cam drive system for positive control of the puncture pin, an improved means for positioning the cam lever arm, an improved positive dynamic seal of the puncture pin, and an emergency bleed system in case of puncture failure. The manifold body is preferably an integral molding of strong and impact resistant plastic material with a continuous passage within the molded plastic that provides a path for the compressed gas of the attached cartridge to flow to the desired article to be inflated, eliminating any possible areas of leakage.

5 Claims, 2 Drawing Sheets

INFLATION MANIFOLD

This invention relates to an inflation manifold assembly. Although in its broader aspects the invention is not limited thereto, the invention illustrated is used with a compressed gas cartridge assembled to an inflation manifold for use with an inflatable article such as a life vest, life raft, and other aircraft and marine safety items. In the described assembly, the inflation manifold is described being used in conjunction with a standard inflation valve that is either heat sealed or cemented to the inflatable article. The manifold incorporates the standard D hole for mounting to the standard inflation valve to prevent rotation. The inflation manifold also utilizes the standard cap nut and seal rings that are standard for preventing leakage on these standard inflation valves. It is among the objects of the present invention to provide an inflation manifold of improved construction, the body of such manifold being integral and being molded of high impact plastic polycarbonate resins, such as those sold under the trademark LEXAN by General Electric Company.

Yet another object of the invention lies in the provision of an improved positive drive system that exerts absolute control over the puncture pin, both while piercing and retracting motions and eliminates the use of springs.

A further object of the invention is the provision of special S shaped protrusions on a radius point on the puncture pin to provide extension openings in a gas cartridge seal.

While another object of the invention provides an improved dynamic seal for the above puncture pin.

The above and further objects and novel features of the invention will more fully appear from the following description when it is read in conjunction with the accompanying drawings. It is expressly understood, however, that the drawings are for the purpose of illustration only, and are not intended as a definition of the limits of the invention.

In the drawings, wherein like reference characters refer to like parts throughout the several views.

Figure 4B:
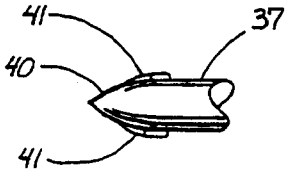
Figure 4A:
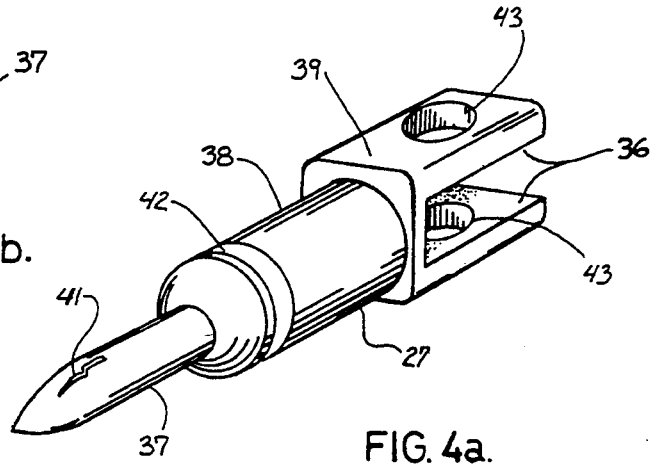
Figure 5:
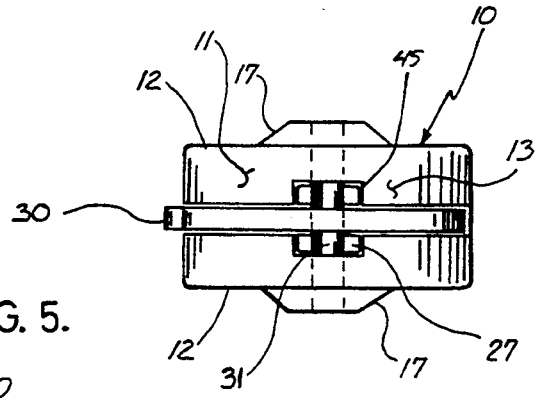
Figure 6:
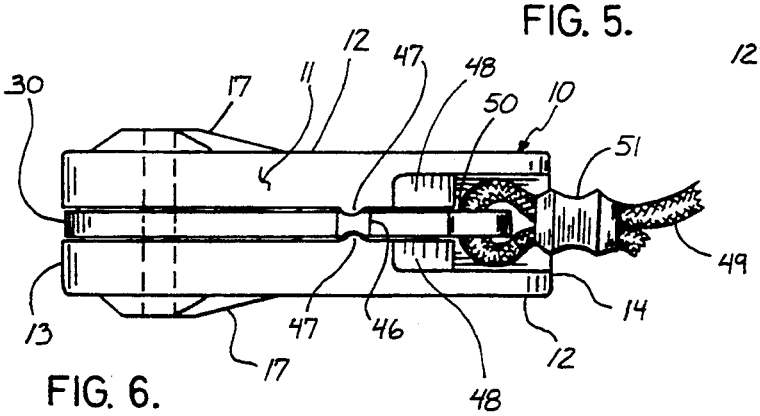
Figure 7:
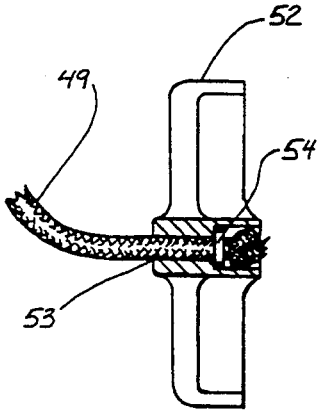

FIG. 4*a* is a view of the puncture pin in perspective for clarity, in larger scale;

FIG. 4*b* is a view of the puncture tip of the puncture pin of FIG. 4*a* in plan, also shown in larger scale;

FIG. 5 is a view in elevation of the puncture pin insertion end of the inflation manifold;

FIG. 6 is a view in elevation of the cam lever side of the inflation manifold;

FIG. 7 is a view in elevation of the lanyard handle, with the center assembly in partial section.

Figure 1:
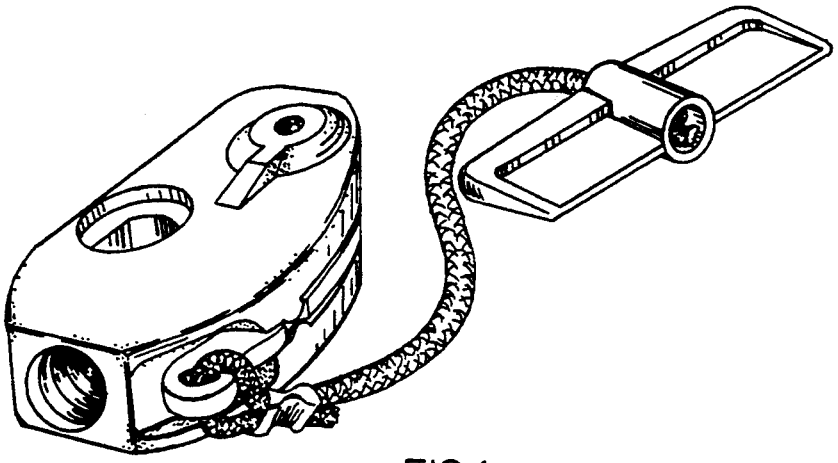
FIG. 1 is a perspective view of the inflation manifold with lanyard handle and lanyard cord attached.

FIG. 1 is a perspective view of the inflation manifold with an activation lanyard cord and lanyard handle connected to the cam lever arm. The illustrative inflation manifold in accordance with the present invention is designated generally by the reference character 10.

Figure 2:
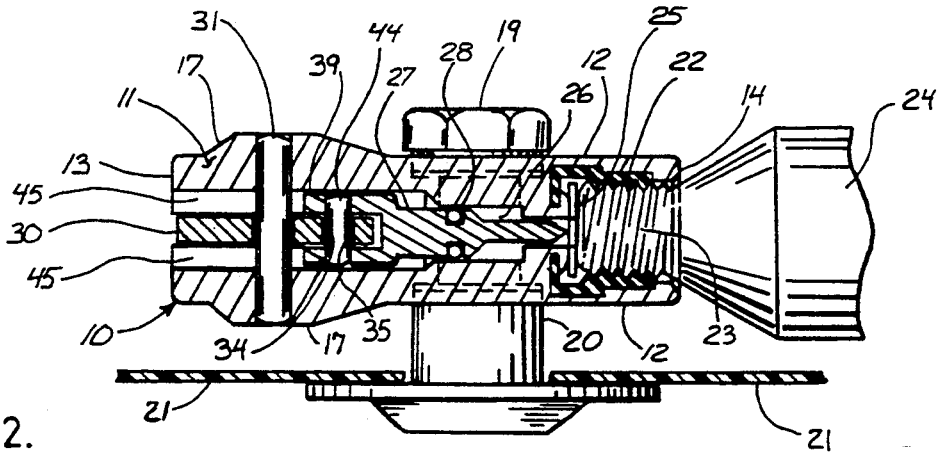
FIG. 2 is a view on an enlarged scale in transverse, horizontal section, through the inflation manifold, inflation valve, and mounting flange bonded to a fragment of and inflatable body, certain of the parts being shown in plan.
Figure 3:
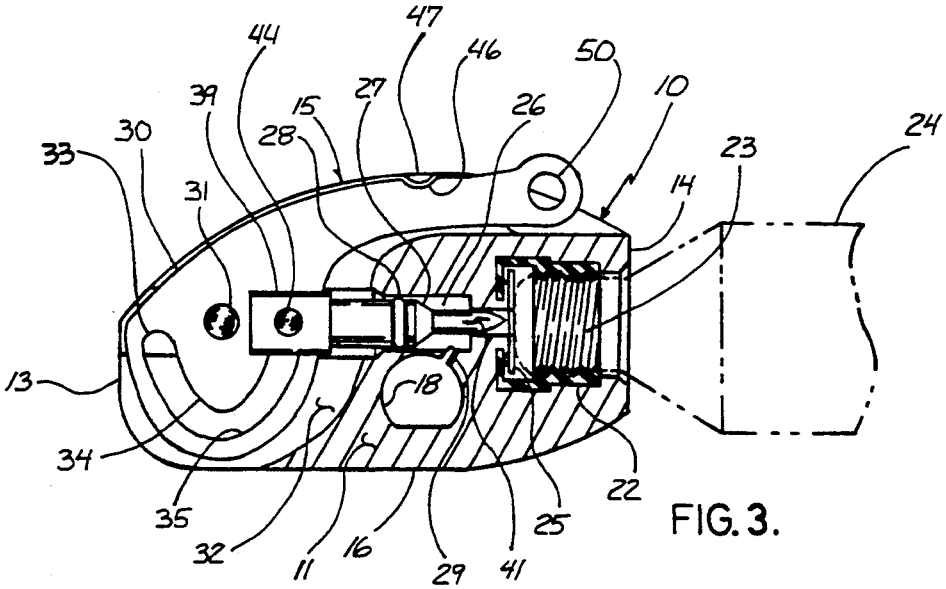
FIG. 3 is a view partially in longitudinal vertical section and partly in elevation, of the inflation manifold of FIG. 1.

The embodiment of the manifold illustrated in the drawings have a body 11 generally in the form of a thick disc, having parallel front and rear sides 12 as shown in FIGS. 2,5 and 6, and parallel longitudinally spaced ends 13 and 14. The upper surface 15 of the manifold is completely curved and the lower surface 16 is primarily straight with blended radius surfaces at each end as shown in FIG. 3. There are two raised bosses 17 on each of the front and rear sides 12 of the manifold. The manifold has a recessed transverse D hole 18 from the front side to the rear side 12 of the manifold. This D hole 18 in the manifold matches the D section of a standard inflation valve 20 which prevents the inflation manifold from being rotated. Cap nut 19 is screwed onto the threaded outer end of the valve body 20 through D hole 18 sealed by two flat rubber washers, one on each side of the manifold as shown in FIG. 2. The standard valve body 20 is fastened to an inflatable article 21 by either heatsealing or use of adhesives as also shown in FIG. 2.

The body 11 of the manifold is provided with a threaded insert 22 for receiving the threaded neck 23 of a gas cartridge 24 as shown in FIGS. 2 and 3. This thread insert 22 is located in end 14 of the manifold body 11.

It is understood that the gas cartridge 24 has a sealing disc of soft metal spanning its thread neck 23, that has to be pierced to release the gas contained by the cartridge.

The cartridge 24 is screwed into the integral molded threaded insert 22 and the neck 23 is sealed to the inflation manifold by a rubber seal 25 shown in FIGS. 2 and 3.

There is a circular chamber 26 formed by the cartridge 24 and seal 25 and the puncture pin 27 and 0 ring seal 28, FIGS. 2 and 3. The puncture pin 27 and 0 ring seal 28 form a positive dynamic seal to that end of circular chamber 26. An exit passage 29 between circular chamber 26 and D hole 18 allows the free migration of gas within the manifold body 11, FIG. 3. When the release of gas is required, this metal seal of the gas cartridge 24 is pierced and gas flows to circular chamber 26 and then through exit passage 29 into D hole 18 as shown in FIG. 3. The gas then flows into the valve body 20 which is in a sealed chamber formed by cap nut 19 and two seal rings and then to the inflated article that is to be inflated as shown in FIG. 2.

The soft metal seal of the cartridge 24 is pierced, when it is necessary to inflate the inflatable article, by means of a cam lever 30 FIG. 3. When in the inoperative position, cam lever 30 lies in a protected cavity of body 11. This cam lever 30 is pivotally mounted upon a transverse pivot pin 31 which extends from one side of the manifold body 11 to the other and spans a narrow, longitudinally extending cam lever receiving slot 32 which extends longitudinally across the top of and down one side of the manifold body 11 FIG. 3. The wide circular end of cam lever 30 has a hole for the pivotal pin 31 and an asymmetrical slot 33 shown in FIG. 3. The two side surfaces of slot 33 form two constantly fluctuating radius surfaces forming two distinct inside 34 and outside 35 cam surfaces shown in FIGS. 2 and 3. Puncture pin 27 has a slotted area at one end 36 in which the cam lever 30 is inserted as shown in FIG. 4*a*. The puncture pin 27 is constructed of two circular concentric sections, one consisting of the pin 37, the second circular area consists of the circular seal area 38, and finally, the rectangular rear guide and drive section 39 as shown in FIG. 4*a*. The pin section 37 has a constant radius formed to a puncture point 40, FIG. 4*b*. At a distance before the constant diameter of the puncture pin section 37, is formed an S shaped protrusion 41 on opposite sides of the pin. This S shaped protrusion 41 continues beyond the outside diameter of the puncture pin section 37 as to cause an interference with any seal surface of the contacted cartridge 24 as shown in FIG. 3.

The second circular seal area 38 has an 0 ring groove 42 that is fitted with the correct size 0 ring 28 to seal in the circular chamber 26 of body 11, FIGS. 2 and 3. The rectangular guide and drive area 39 has drive pin holes 43 on opposite sides of the cam lever slot 36. The puncture pin 27 is held in position to cam lever 30 by a cam drive pin 44 as shown in FIG. 2–3. To keep the pin 27 from rotating upon piercing the seal of cartridge 24, because of the S shaped protrusions, a rectangular guide shape 45 is provided in the body 11 shown in FIGS. 2 and 5. This construction allows absolute control of pin 27, through the connection of cam drive pin 44 to the dual cams surfaces 34 and 35 of slot 33 of the cam lever 30. This construction also provides for a larger, tight fitting dynamic 0 ring seal 28 to be fitted on puncture pin 27, which reduces leakage and which could not be provided by a spring return puncture pin. Pin 27 is driven into the cartridge seal by the high point of the inside cam 34. The puncture pin 40 has been driven into the cartridge seal and the S shape protrusion 41 have made two small clearance hole extensions on the sides of the main hole in the seal area.

If the puncture pin 27 locks for some unknown or unforeseen reason in the cartridge seal, these small clearance hole extensions made by the S shape protrusion 41 on the puncture pin 27 will provide a reasonable flow of gas in the emergency situation to inflate the article at a much reduced rate. With the continued counter clockwise action of cam lever 30, the cam drive pin 44 has been transferred to the outside cam surface 35 of slot 33, which is now pulling the puncture pin 27 out of the cartridge seal and returning it to a retracted position similar in position to where it started. With the puncture pin 27 removed from the cartridge seal, gas is permitted to flow unrestricted through the inflation manifold 10 to the inflation valve 20 of the inflatable article.

A provision is made for providing extra resistance on the cam lever 30 in the closed position. A notch 46 on the cam lever arm 30 as shown in FIGS. 3 and 6 fits below a raised radius bump 47 on the side surface 15 of body 11, FIGS. 3 and 6 and directly on the cam lever receiving slot 32 to provide a slight pull resistance on the initiation of action to the cam lever 30. These raised radius bumps 47 prevent the unwanted movement of the cam lever arm 30 in a seal piercing direction, but require a deliberate, reasonably strong pull exerted on the lanyard cord 49 to pierce the cartridge seal. A wider recess 48 is provided in the body 11 at the end of the cam lever receiving slot 32 for connection of a braided nylon lanyard cord 49 to the cam lever 30. The lanyard cord 49 is passed through a hole 50 in the cam lever 30 and then the two parallel portions of the lanyard cord 49 are crimped together with a standard commercial crimp 51 as shown in FIG. 6. This crimp 51 retains the lanyard cord 49 to the cam lever arm 30 so securely that there is no possibility of slippage of the cord in the fastener under severe conditions.

The lanyard handle 52 is connected to the lanyard cord 49 to provide a convenient way to activate the inflation manifold 10. The lanyard cord 49 is slipped through a molded hole 53 in the lanyard handle 52 and also through a washer 54 as shown in FIG. 7. The lanyard cord is tied into a knot or is crimped at a predetermined length and when the cord is pulled back through the molded hole 53, washer 54 prevents the knot or crimp from pulling through the molded hole 53 securing the lanyard handle 52 to the end of the lanyard cord 49.

Although the invention is illustrated and described with reference to a single preferred embodiment thereof, it is to be expressly understood that it is in no way limited to the disclosure of such a preferred embodiment, but is capable of numerous modifications within the scope of the appended claims.

What is claimed is:

1. An inflation manifold for inflatable articles comprising:

a manifold body mountable on the inflatable article;

a cartridge having a threaded neck and a seal with a puncture area, the cartridge mounted to the manifold body;

a gas conducting chamber within the manifold body having walls which are molded of plastic material;

an internally threaded metal sleeve mounted in the manifold body, said metal sleeve threadedly receiving the threaded neck of the cartridge;

a cam lever arm having an asymmetrical slot with inside and outside cam surfaces connected to the manifold body;

a puncture pin operatively connected with the cam lever asymmetrical slot, said puncture pin located within the manifold body for piercing the puncture area of the seal;

wherein the asymmetrical slot has absolute positive directional control of the puncture pin when the puncture pin is moved by the cam lever arm through piercing and retracting motions.

2. The inflation manifold according to claim 1, wherein a cam drive pin located within the asymmetrical slot between the inside and outside cam surfaces maintains a relative position of the puncture pin during piercing and retracting motions.

3. The inflation manifold according to claim 1, wherein the puncture pin has a positive radius point with S-shape protrusions that enhance the puncture area of the cartridge seal while the puncture pin is engaged in the seal, said S-shape protrusions forming clearance hole extensions in the seal to provide a flow of gas when the puncture pin is in the piercing position.

4. The inflation manifold according to claim 1, wherein the puncture pin has an O-ring seal that provides resistance to pin motion and gas leakage.

5. The inflation manifold according to claim 1, wherein the body has integral molded locks to keep the cam lever in position and from being accidentally activated.

* * * * *